US010281836B2

(12) United States Patent
Nagamine

(10) Patent No.: US 10,281,836 B2
(45) Date of Patent: May 7, 2019

(54) IMAGE FORMING APPARATUS

(71) Applicant: Oki Data Corporation, Tokyo (JP)

(72) Inventor: Masamitsu Nagamine, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/897,950

(22) Filed: Feb. 15, 2018

(65) Prior Publication Data

US 2018/0275556 A1 Sep. 27, 2018

(30) Foreign Application Priority Data

Mar. 23, 2017 (JP) ..... 2017-056809

(51) Int. Cl.
*G03G 15/04* (2006.01)
*G03G 15/043* (2006.01)

(52) U.S. Cl.
CPC ..... *G03G 15/043* (2013.01); *G03G 15/04036* (2013.01); *G03G 2215/0409* (2013.01)

(58) Field of Classification Search
CPC ..... G03G 15/04; G03G 15/043; G03G 15/04036; G03G 15/0409; G03G 2215/0409
See application file for complete search history.

(56) References Cited

U.S. PATENT DOCUMENTS 6,801,232 B2 * 10/2004 Nagamine ..... B41J 25/308 347/149

FOREIGN PATENT DOCUMENTS

JP 2011-145684 A 7/2011

* cited by examiner

*Primary Examiner* — Hoang X Ngo
(74) *Attorney, Agent, or Firm* — Muncy, Geissler, Olds & Lowe, P.C.

(57) ABSTRACT

An image forming apparatus includes a photosensitive drum that rotates in a predetermined direction, an LED head that exposes the photosensitive drum, a drum contact surface that contacts against the outer peripheral surface of the photosensitive drum, and a head contact surface that contacts the LED head. Further, the image forming apparatus includes a spacer for regulating a distance between the photosensitive drum and the LED head, and a coil spring for pressing the LED head toward the spacer. The LED head has an engagement hole to engage the spacer. The spacer has a protrusion that engages with the engagement hole and regulates movement of the LED head in a predetermined direction.

20 Claims, 14 Drawing Sheets

IMAGE FORMING APPARATUS

TECHNICAL FIELD

The field of the disclosed subject may relate to an image forming apparatus having an exposure unit.

BACKGROUND ART

In an image forming apparatus using an electrophotography, an exposure unit irradiates light onto a surface of an image carrier (for example, photosensitive drum) to form an electrostatic latent image, and the electrostatic latent image is developed and transferred to a medium.

For example, Japanese Patent Application Laid-Open (JP-A) No. 2011-145684 discloses a configuration for positioning an exposure unit with respect to an image carrier.

It is required to enable positioning between an exposure unit and an image carrier with a simpler configuration.

The present invention makes it possible to position the exposure unit and the image carrier with a simpler configuration.

SUMMARY

The invention relates to an image forming apparatus, which includes (1) an image carrier configured to rotate in a predetermined direction; (2) an exposure unit configured to expose the image carrier; (3) a spacer that includes a first contact portion contacting against an outer peripheral surface of the image carrier and a second contact portion contacting against the exposure unit, and configured to regulate the interval between the image carrier and the exposure unit; and (4) a pressing portion configured to press the exposure unit toward the spacer. The exposure unit includes a first engagement portion that engages with the spacer. The spacer includes a second engagement portion that engages with the first engagement portion and restricts movement of the exposure unit in the predetermined direction.

BRIEF DESCRIPTION OF THE DRAWINGS

The accompanying drawings are presented to aid in the description of examples of one or more aspects of the disclosed subject matter and are provided solely for illustration of the examples and not limitation thereof.

DESCRIPTION OF THE EMBODIMENTS (1) First Embodiment

<A Basic Configuration of an Image Forming Apparatus>

Figure 1:
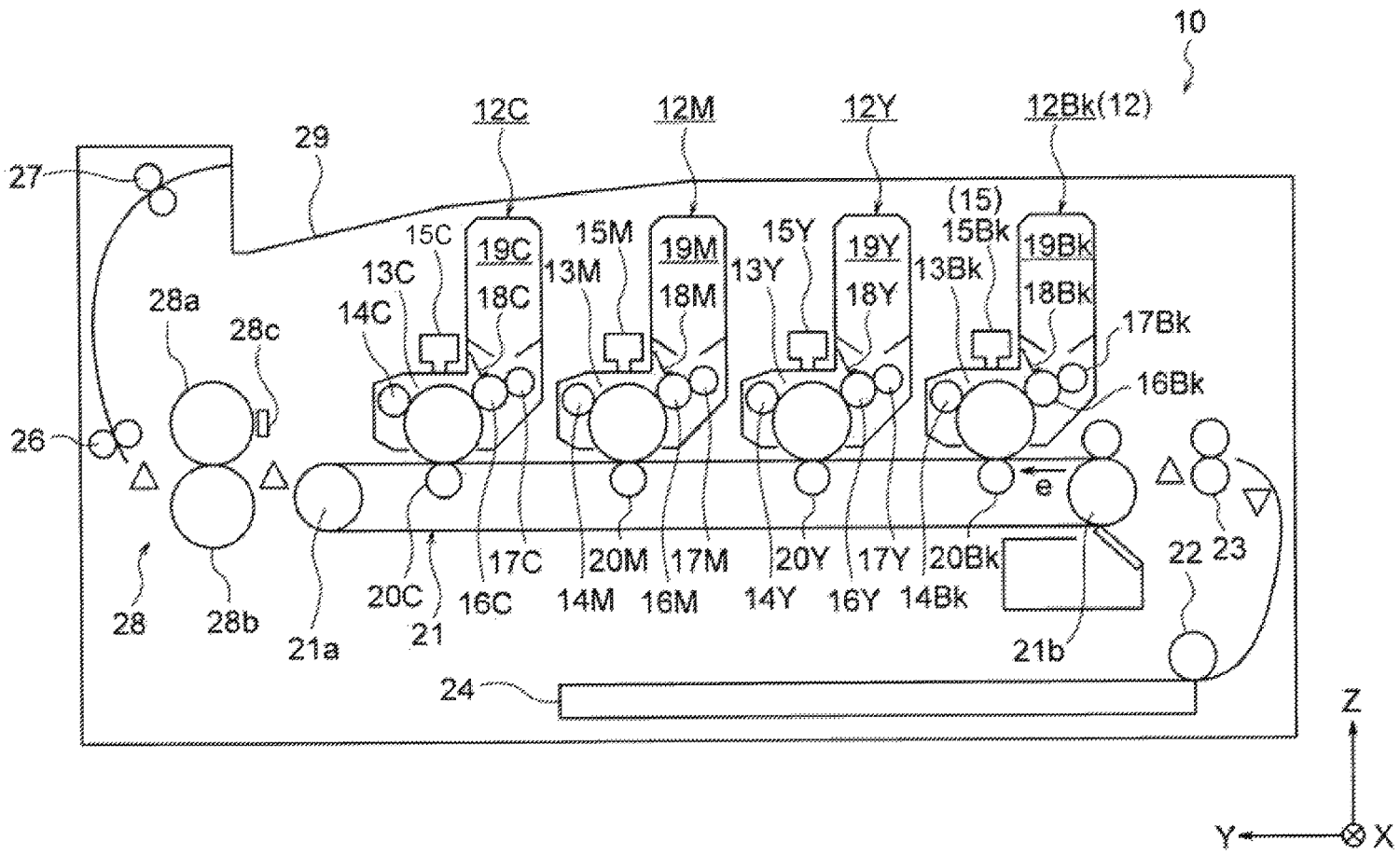
FIG. 1 is a diagram illustrating a basic configuration of an image forming apparatus according to a first embodiment.

FIG. 1 is a diagram illustrating the basic configuration of the image forming apparatus 10 according to the first embodiment. For example, the image forming apparatus as shown FIG. 1 is a color printer. The image forming apparatus 10 has process units (image forming units) 12Bk, 12Y, 12M, and 12C for forming images of black (Bk), yellow (Y), magenta (M) and cyan (C). The process units 12Bk, 12Y, 12M, and 12C will be described as "the process unit 12".

The process unit 12 is arranged from the upstream side to the downstream side (here, from the right side to the left side) along the conveying path of the sheet (recording medium). As the recording medium, besides sheet, OHP sheets, envelopes, copying sheets, special sheets or the like can be used.

The process unit 12 includes cylindrical photosensitive drums 13Bk, 13Y, 13M, and 13C as image carriers. The photosensitive drums 13Bk, 13Y, 13M, and 13C will be described as "the photosensitive drum 13". Further, the process unit 12 includes charge rollers 14Bk, 14Y, 14M, and 14C as charge members for uniformly charging the surface of the photosensitive drum 13. The charge rollers 14Bk, 14Y, 14M and 14C will be described as "the charge roller 14". Further, the process unit 12 includes development rollers 16Bk, 16Y, 16M and 16C as developer carriers. The development rollers 16Bk, 16Y, 16M and 16C form toner images by adhering toner of each color to the electrostatic latent image formed on the surface of the photosensitive drum 13. The development rollers 16Bk, 16Y, 16M and 16C will be described as "the development roller 16".

In the process unit 12, toner supply rollers 17Bk, 17Y, 17M and 17C as supply members for supplying toner to the development roller 16 are disposed so as to be in contact with the development roller 16. The toner supply rollers 17Bk, 17Y, 17M and 17C will be described as "the toner supply roller 17". In the process unit 12, development blades 18Bk, 18Y, 18M, and 18C for regulating the thickness of the toner layer formed on the surface of the development roller 16 are disposed. The development blades 18Bk, 18Y, 18M and 18C will be described as "the development blade 18". Toner cartridges 19Bk, 19Y, 19M, and 19C as developer containers for dropping and supplying the toner are attached to the upper side of the toner supply roller 17. The toner cartridges 19Bk, 19Y, 19M and 19C will be described as "the toner cartridges 19".

On the upper side of the process unit 12, LED heads 15Bk, 15Y, 15M, and 15C as exposure units are arranged so as to face the photosensitive drum 13, respectively. The LED heads 15Bk, 15Y, 15M and 15C will be described as "the LED head 15". The LED head 15 exposes the surface of the photosensitive drum 13 to form an electrostatic latent image according to the image data of each color.

On the lower side of the process unit 12, a transfer unit is disposed. The transfer unit includes a conveyance belt 21 as a conveyance member that travels while picking up a sheet, a drive roller 21*a* that drives the conveyance belt 21, a tension roller 21*b* that applies a tension to the conveyance belt 21, and a transfer rollers 20Bk, 20Y, 20M, 20C as transfer members arranged to face the photosensitive drum 13 via the conveyance belt 21. The transfer rollers 20Bk, 20Y, 20M and 20C electrify the sheet with the polarity opposite to that of the toner, and transfer the toner images of the respective colors formed on the photosensitive drum 13 to the sheet.

A fuser device (fuser apparatus) 28 is disposed on the downstream side (the left side in the drawing) of the image forming apparatus 10. The fuser device 28 includes a fuser roller 28*a*, a pressure roller 28*b*, and a temperature sensor 28*c* that detects the surface temperature of the fuser roller 28*a*. The fuser roller 28*a* and the pressure roller 28*b* apply heat and pressure to the toner image transferred to the sheet and fuse it on the sheet.

A sheet feeding mechanism for supplying the sheet to the conveying path is disposed in the lower part of the image forming apparatus 10. The sheet feeding mechanism includes a sheet cassette 24 as a medium container for storing the sheet, a hopping roller 22 for feeding out the sheets one by one stored in the sheet cassette 24, and a pair of registration rollers 23 for conveying the sheet fed out by the hopping roller 22 to the conveyance belt 21.

Further, on the downstream side of the fuser device 28, a discharging mechanism for discharging the sheet is disposed. The discharge mechanism includes a pair of discharge rollers 26 and 27 that transports the sheet discharged from the fuser device 28 and discharges the sheet from the discharge port. On the upper surface of the image forming apparatus 10, a stacker unit 29 for placing the sheet discharged by the pair of discharge rollers 26 and 27 is disposed.

In the above configuration, the direction of the rotation axis of each photosensitive drum 13 of the process unit 12 is defined as the X direction. Further, the moving direction of the sheet (recording medium) when passing through the process unit 12 is defined as the Y direction (more specifically, the +Y direction). Further, the direction orthogonal to both the X direction and the Y direction is defined as the Z direction. Here, the Z direction is the vertical direction, the upper side is the +Z direction, and the lower side is the −Z direction.

<Configuration of the LED Head>

Next, the configuration of the LED head 15 as the exposure unit will be described.

Figure 2:
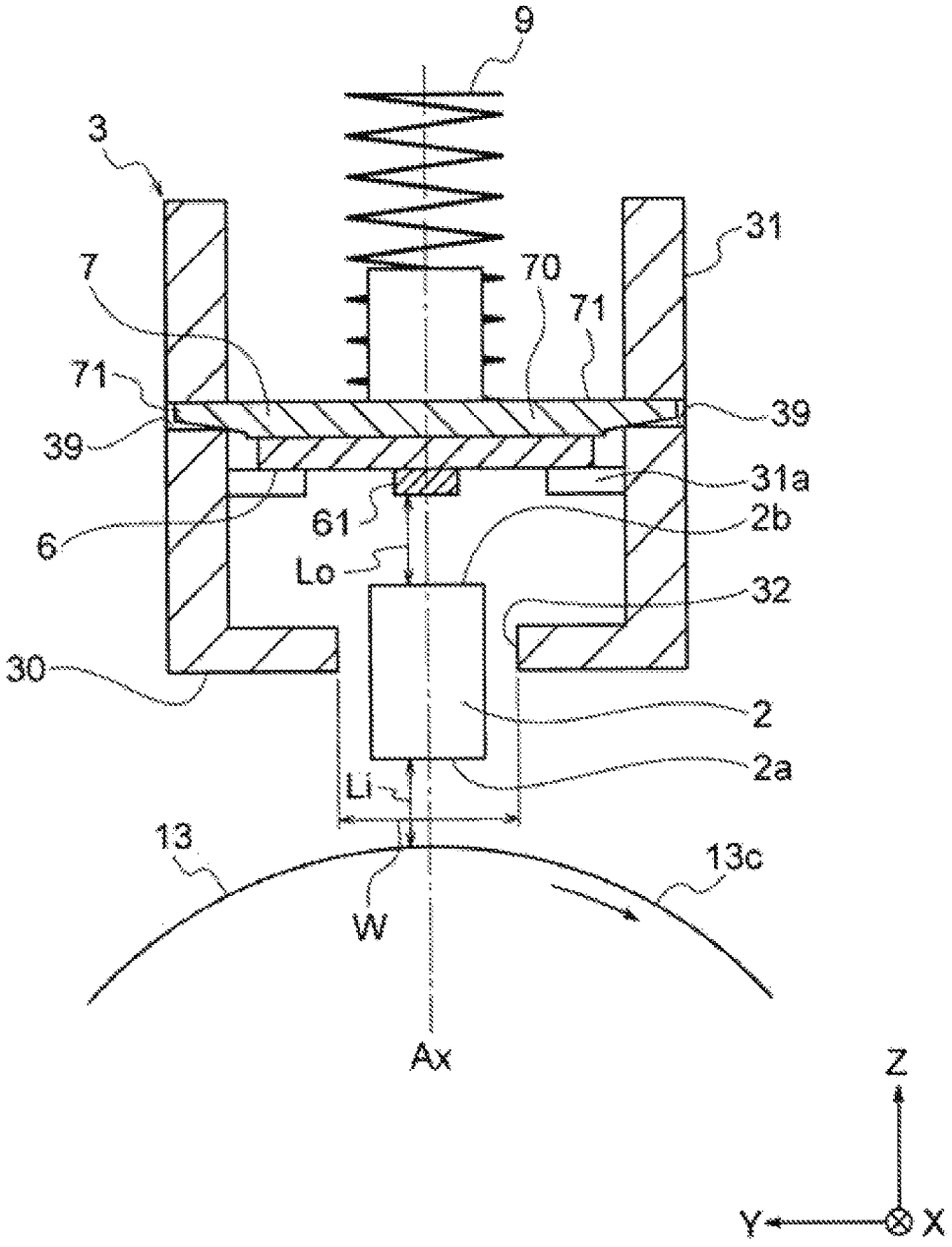
FIG. 2 is a cross-sectional view illustrating an LED head according to the first embodiment.
Figure 3:
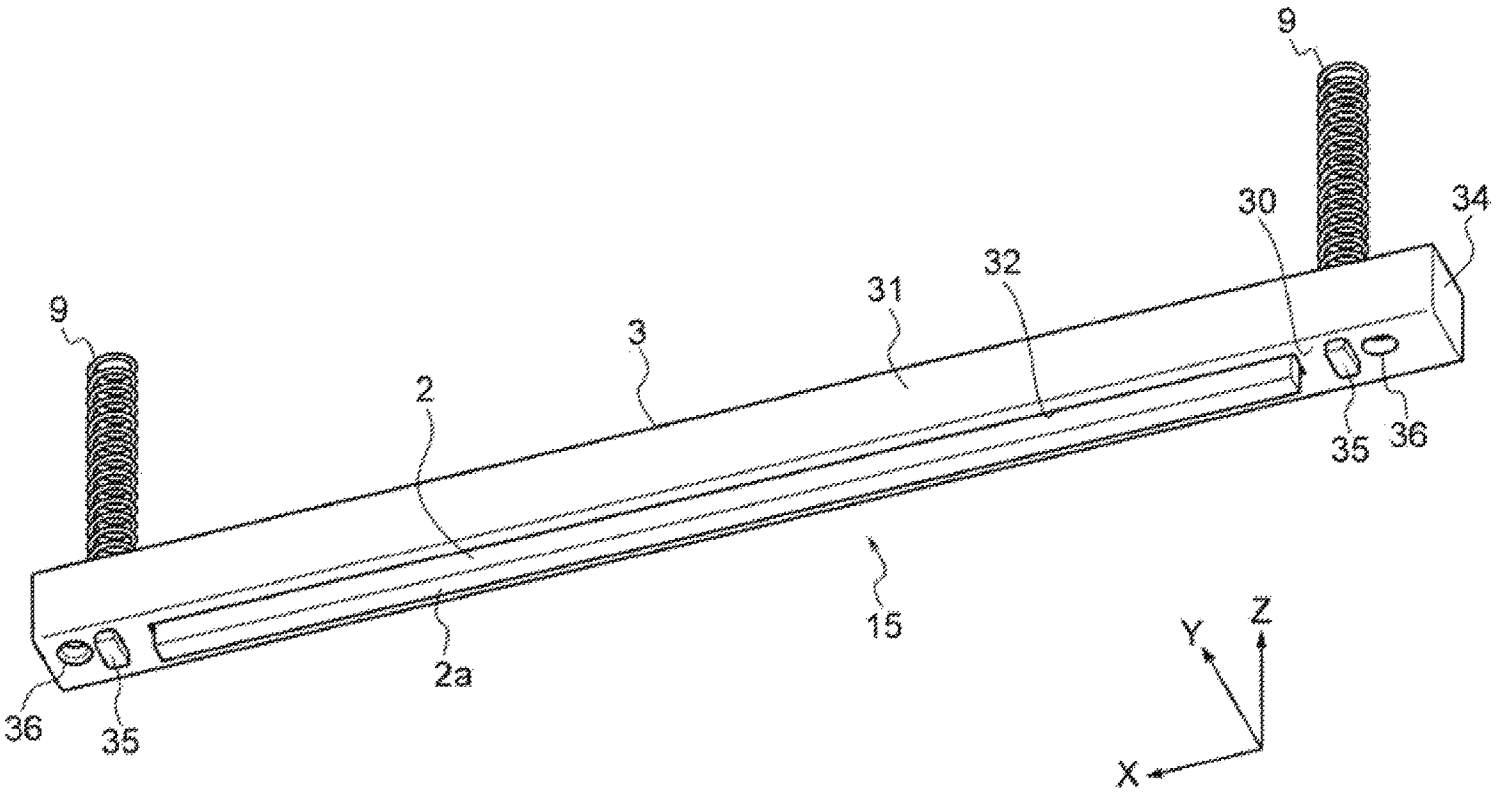
FIG. 3 is a perspective view illustrating an LED head according to the first embodiment.
Figure 4:
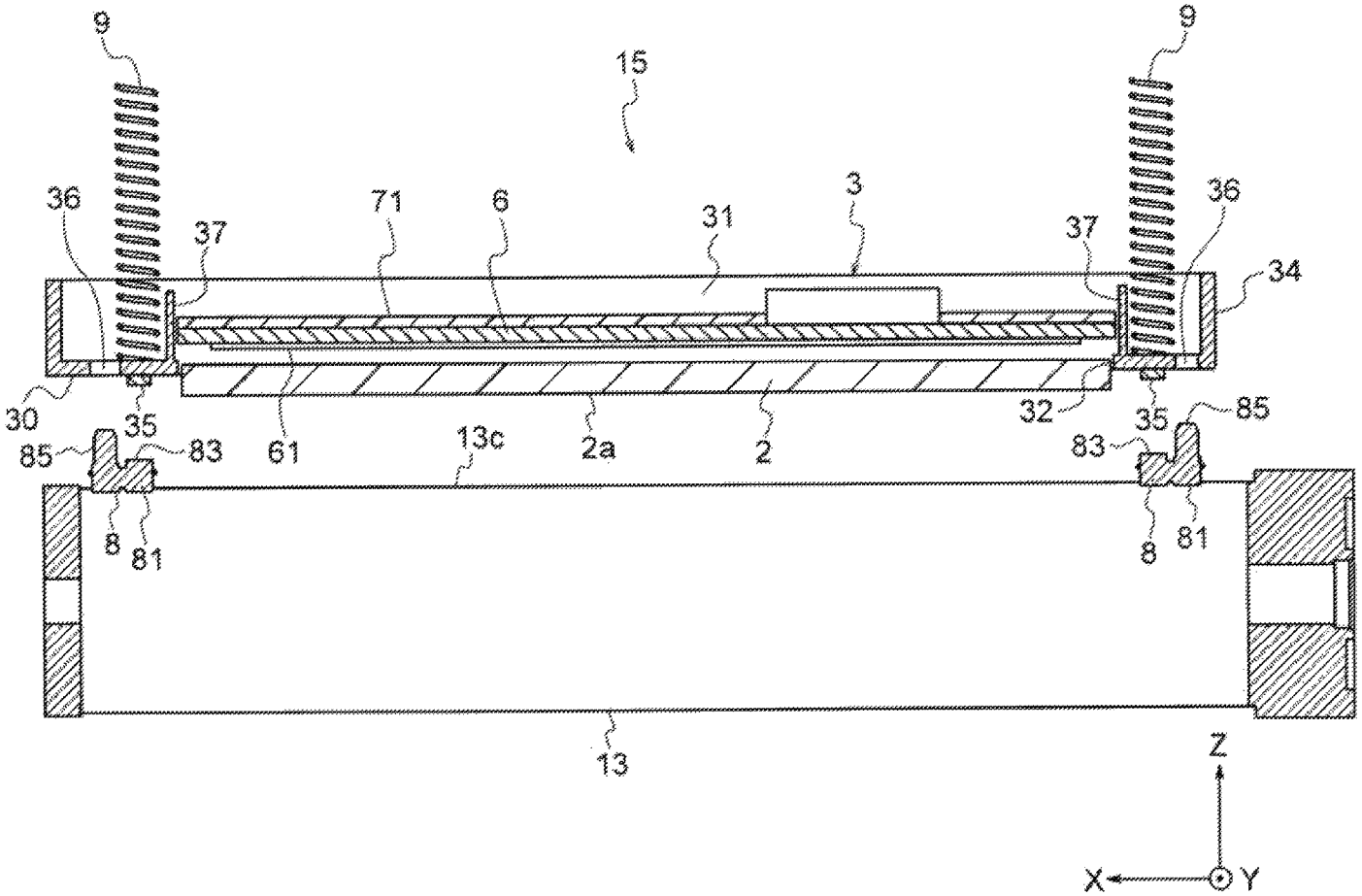
FIG. 4 is a longitudinal sectional view illustrating the LED head, a photosensitive drum and a spacer according to the first embodiment.

FIG. 2 is a cross-sectional view illustrating an LED head 15 according to the first embodiment. FIG. 3 is a perspective view illustrating an LED head 15 according to the first embodiment. FIG. 4 is a longitudinal sectional view illustrating the LED head 15, a photosensitive drum 13 and a spacer 8 according to the first embodiment. That is, FIG. 4 is a sectional view taken along a plane parallel to the XZ plane. In FIG. 4, the LED head 15 is separated from a surface 13*c* of the photosensitive drum 13.

As shown in FIG. 2, the LED head 15 includes an LED array chip 61 having LEDs (light emitting diodes) as a plurality of light emitting elements arranged to face the photosensitive drum 13, and a substrate 6 on which the driver IC (not shown) so as to control the LED array chip 61. The plurality of LEDs of the LED array chip 61 are arranged in a line in the X direction. Further, the substrate 6 is made of, for example, a glass epoxy resin.

The LED head 15 includes a rod lens array 2 as an optical system arranged so as to face the substrate 6. The rod lens array 2 has a plurality of rod lenses (convergence lens) for imaging the light radiated from each LED of the LED array chip 61 on the surface 13*c* of the photosensitive drum 13. The plurality of rod lenses of the rod lens array 2 are arranged in one line or a plurality of lines in the X direction with the optical axis direction being the Z direction.

Since the plurality of LEDs of the substrate 6 and the plurality of rod lenses of the rod lens array 2 are arranged in the X direction, the X direction is also called the main scanning direction. The Y direction is also called a sub scanning direction.

The LED head 15 has a holder 3 as a support member for supporting the substrate 6 and the rod lens array 2. The holder 3 is an elongated member elongated in the X direction, and is formed of, for example, a die-cast molded body of aluminum. The holder 3 has a pair of side wall portions 31 (side plate portions) opposed in the Y direction and a bottom portion 30 (bottom plate portion) facing the photosensitive drum 13.

An opening portion 32 for inserting the rod lens array 2 is formed in the bottom portion 30 of the holder 3. The rod lens array 2 is inserted into the opening portion 32 with the optical axis direction of each rod lens facing the Z direction. Due to the characteristics of the rod lens array 2, the rod lens array 2 is positioned in the Z direction so that the distance Lo between the incident end surface 2*b* and the LED array chip 61 is the optimum distance, and fixed to the holder 3 with an adhesive or the like. The gap between the rod lens array 2 and the opening portion 32 is sealed by, for example, a sealing material (not shown).

On the side wall portion 31 of the holder 3, a substrate contact portion 31*a* which is in contact with the lower surface (the surface on the −Z side) of the substrate 6 is formed. Above the substrate 6 (in the +Z direction), a pressing member 7 for pressing the substrate 6 against the substrate contact portion 31*a* is disposed. The pressing member 7 is a plate-shaped member made of plastic, and the engagement piece 71 protrudes from both ends in the Y direction.

The engagement piece 71 of the pressing member 7 is engaged with a slit 39 formed in the side wall portion 31 of the holder 3. In a state before engaging with the slit 39, the engagement piece 71 of the pressing member 7 has a shape that warps somewhat upward. When the engagement piece 71 is engaged with the slit 39, the engagement piece 71 is elastically deformed, and the pressing member 7 presses the substrate 6 against the substrate contact portion 31*a* by its elastic force.

A plurality of the engagement pieces 71 and the slits 39 are arranged at equal intervals in the X direction. Thereby, the pressing member 7 can press the substrate 6 with uniform force in the X direction.

The photosensitive drum 13 is a cylindrical member and rotates clockwise in FIG. 2. In the portion facing the LED head 15, the movement direction of the surface 13*c* of the photosensitive drum 13 is the −Y direction. Further, the photosensitive drum 13 has a pair of flanges 13*b* (FIG. 13) at both ends in the axial direction. At the center of the photosensitive drum 13, a drum shaft 13*a* (FIG. 13) is provided so as to penetrate the flange 13*b*.

In order to accurately converge (image) the light emitted from each lens element of the rod lens array 2 on the surface 13*c* of the photosensitive drum 13, it is desirable to adjust so that the distance Lo and the distance Li are substantially the same (Lo≈Li). One way to achieve this is to adjust the distance Li.

Therefore, a pair of coil springs 9 serving as pressing portions for pressing the LED head 15 toward the photosensitive drum 13 are disposed at both ends in the X direction of the LED head 15. The axial direction of the coil spring 9 is the Z direction (FIGS. 3 and 4). The upper end of the coil spring 9 is fixed to the main body of the image forming apparatus 10. The lower end of the coil spring 9 is fixed to the bottom portion 30 of the holder 3. A region in which the coil spring 9 is disposed in the holder 3 is partitioned by a wall 37.

A pair of plates 35 as positioning members are attached to both ends in the X direction of the bottom surface of the bottom portion 30 of the holder 3. The plate 35 is made of, for example, polycarbonate or the like.

Further, on the photosensitive drum 13, a pair of spacers 8 are attached so as to be in contact with the respective plates 35. The spacer 8 is formed of, for example, an engineering plastic such as a polyacetal resin. The spacer 8 and the plate 35 regulate the distance between the LED head 15 and the photosensitive drum 13 and position the LED head 15 in the Z direction with respect to the photosensitive drum 13. In this embodiment, the plate 35 is fixed to the holder 3 with an adhesive Ad (FIG. 8) in a state where the distance between the rod lens array 2 and the photosensitive drum 13 is adjusted to be Li. At this time, while keeping the state in which the plate 35 and the spacer 8 are in contact with each other, the plate 35 is fixed to the holder 3 with the adhesive Ad. By fixing the plate 35 to the holder 3 as described above, it can be positioned so that the distance between the rod lens array 2 and the photosensitive drum 13 becomes Li when the plate 35 and the spacer 8 are in contact with each other.

As shown in FIGS. 3 and 4, at the both ends in the X direction of the bottom portion 30 of the holder 3, a pair of engagement holes 36 as first engagement portions to be engaged with a part (a projection 85 to be described later) of the spacer 8 are formed. The engagement hole 36 is arranged on the outer side in the X direction with respect to the plate 35. The engagement hole 36 has a concave portion (a concave shape).

Figure 5:
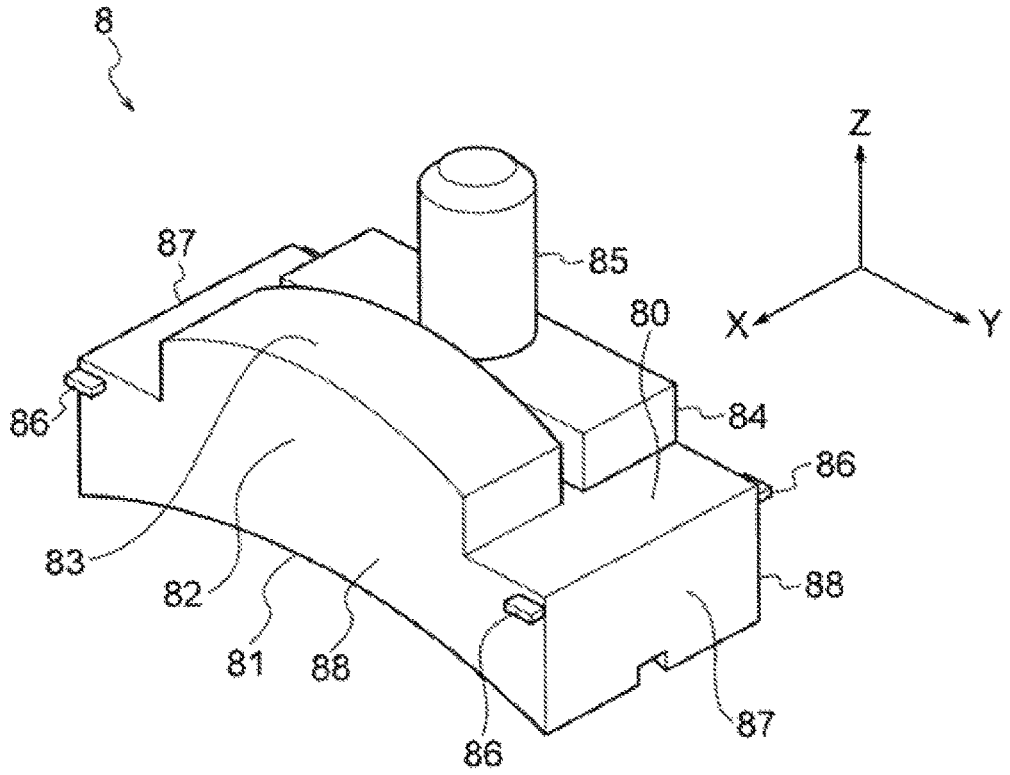
FIG. 5 is a perspective view illustrating a spacer according to the first embodiment.

FIG. 5 is a perspective view illustrating the spacer 8 according to the first embodiment. The spacer 8 has a substantially rectangular parallelepiped shape. The lower surface (the surface on the −Z side) of the spacer 8 is a drum contact surface 81 that is in contact with the surface 13*c* (outer circumferential surface) of the photosensitive drum 13. The drum contact surface 81 is a curved surface having the same curvature as the surface 13*c* of the photosensitive drum 13.

The spacer 8 has a basal plane 80 parallel to the XY plane on the opposite side (the +Z side) to the drum contact surface 81. The spacer 8 has a convex portion 82 projecting upward (the +Z direction) from the basal plane 80. The upper surface (the surface on the +Z side) of the convex portion 82 is a head contact surface 83 as a second contact portion which contacts on the plate 35 of the holder 3. That is, the head contact surface 83 has a convex portion (a convex shape). The head contact surface 83 is a curved surface having a predetermined curvature. For example, the curved surface is a cylindrical surface coaxial with the photosensitive drum 13.

In addition, the spacer 8 has a convex portion 84 that protrudes upward (the +Z direction) from the basal plane 80, adjacent to the convex portion 82 in the Y direction. A protrusion 85 serving as a second engagement portion to be engaged with the engagement hole 36 of the holder 3 is formed to protrude upward (the +Z direction) in the Y direction at the center of the convex portion 84. Although the protrusion 85 is cylindrical in this case, it may have another shape. Further, although the protrusion 85 protrudes from the protrusion 84, it may protrude from the basal plane 80, for example.

Both end surfaces of the spacer 8 in the Y direction are a pair of Y direction end surfaces 87 parallel to the XZ plane. The pair of Y direction end surfaces 87 are surfaces which contact the Y direction energizing portion 53 and the Y direction positioning surface 56 (FIG. 12) of the unit frame 50 (described later) of the process unit 12.

Both end faces of the spacer 8 in the X direction are a pair of X direction end surfaces 88 parallel to the YZ plane. The pair of X direction end surfaces 88 are surfaces which contact the X direction energizing portion 54 and the X direction positioning surface 57 (FIG. 14) of the unit frame 50 of the process unit 12.

A projecting piece 86 projecting in the X direction is formed on the X direction end surface 88 of the spacer 8. The projecting pieces 86 are formed in the vicinity of the upper ends (end portions in the +Z direction) of both end portions in the Y direction of the X direction end surface 88 respectively. The projecting piece 86 is a portion that is held in contact with the receiving portion 52*a* (FIG. 11) formed in the unit frame 50 of the process unit 12.

The spacer 8 has a rectangular shape having a short side in the X direction and a long side in the Y direction, but is not limited to such a shape. In FIG. 5, only one of the spacers 8 is shown, but the pair of spacers 8 are symmetrical with respect to the center of the photosensitive drum 13 in the X direction.

Figure 6:
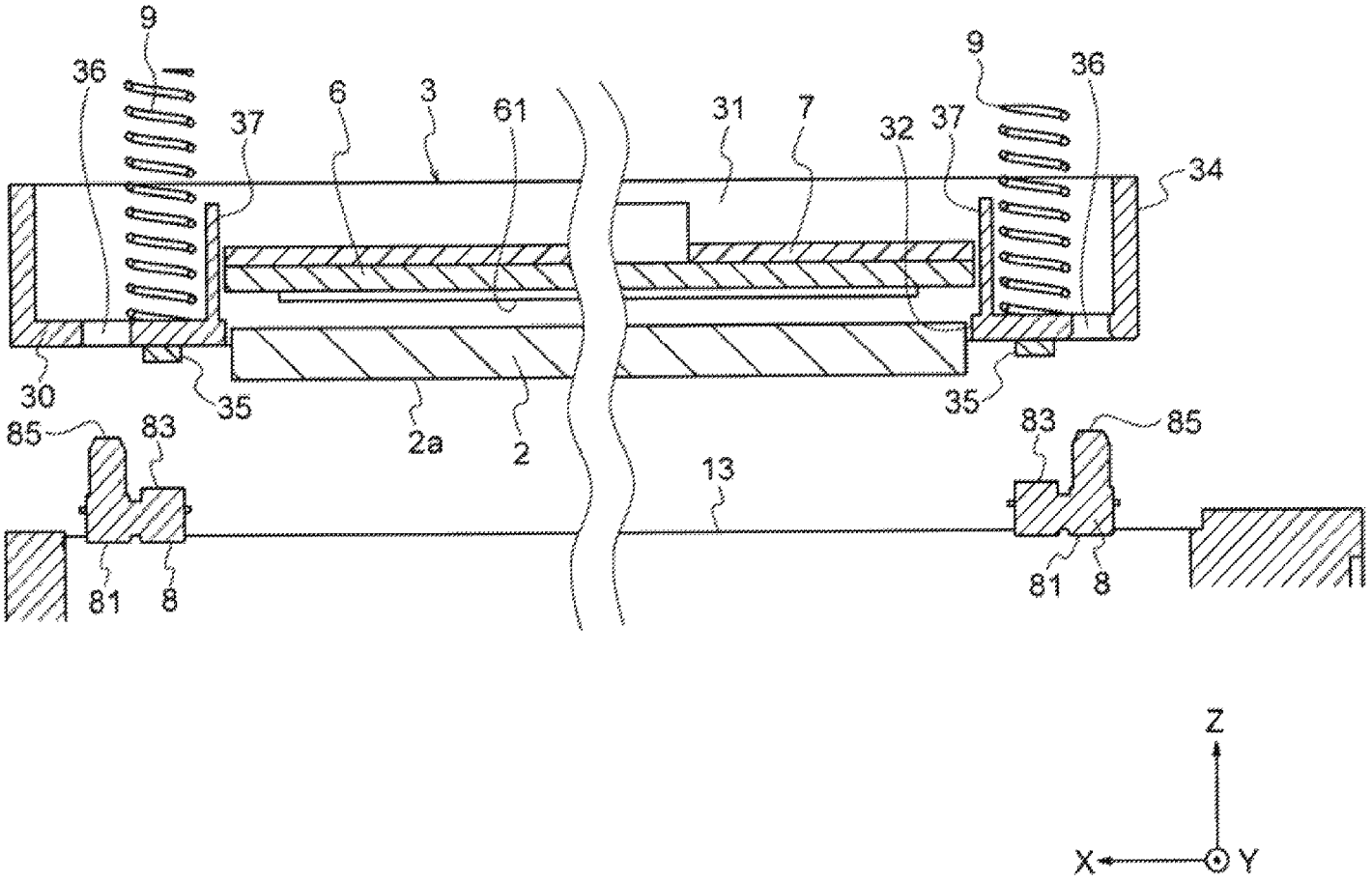
FIG. 6 is an enlarged a longitudinal sectional view illustrating the LED head, the photosensitive drum and the spacer according to the first embodiment.

FIG. 6 is an enlarged a longitudinal sectional view illustrating the LED head 15, the photosensitive drum 13 and the spacer 8 according to the first embodiment. The pair of spacers 8 are arranged so that the drum contact surface 81 contacts against the surface 13*c* of the photosensitive drum 13.

Figure 7:
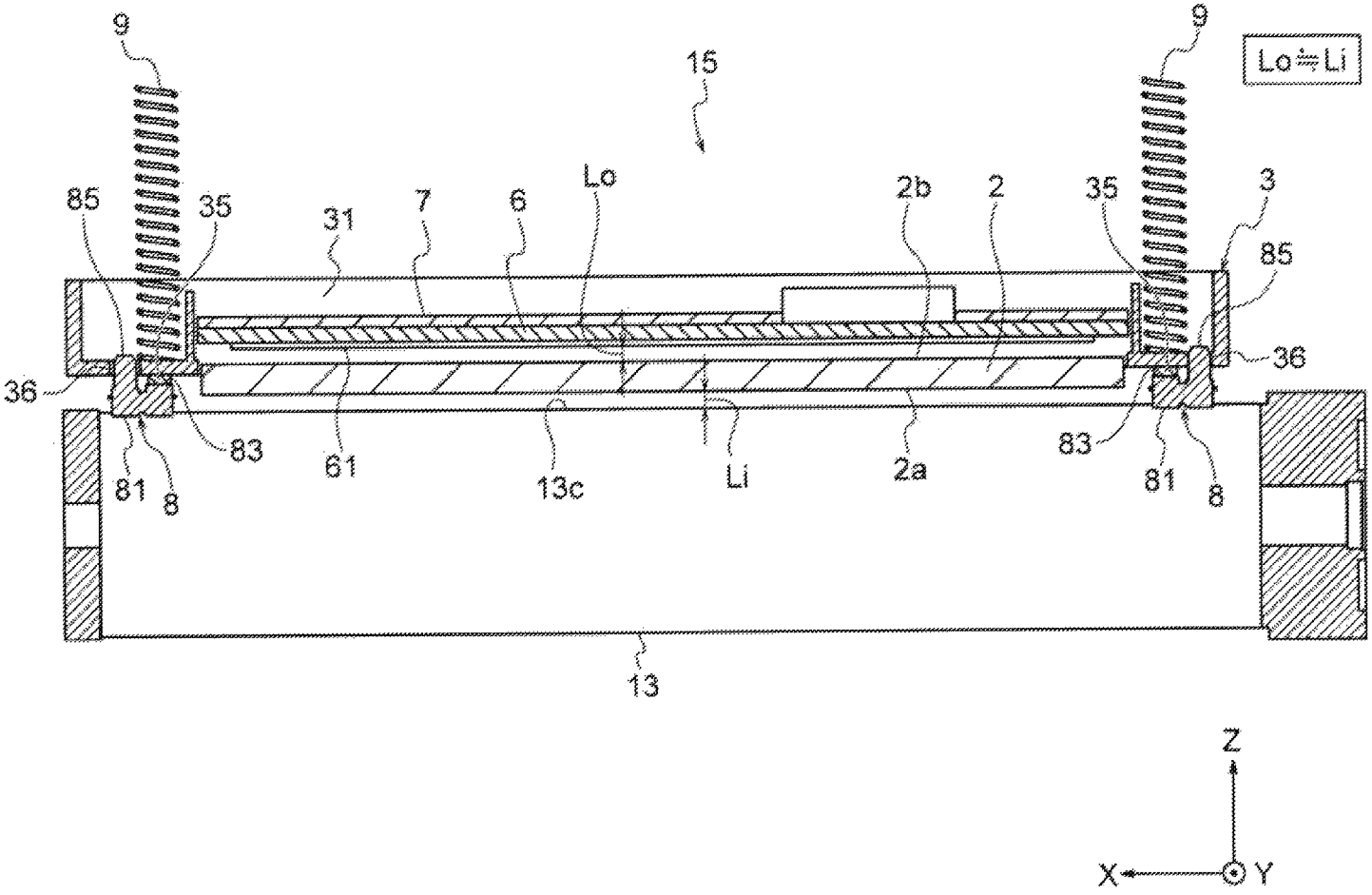
FIG. 7 is a longitudinal sectional view illustrating the LED head, the photosensitive drum and the spacer according to the first embodiment.

FIG. 7 is a longitudinal sectional view illustrating the LED head 15, the photosensitive drum 13 and the spacer 8 in a state where the LED head 15 is attached to the image forming apparatus 10 according to the first embodiment. When the LED head 15 is attached to the image forming apparatus 10, the head contact surface 83 of the spacer 8 contacts against the plate 35 of the holder 3, and the protrusion 85 of the spacer 8 is engaged with the engagement hole 36 of the holder 3.

The positional displacement of the LED head 15 in the X direction and the Y direction is suppressed by engagement between the protrusion 85 of the spacer 8 and the engagement hole 36 of the holder 3. In particular, positional displacement in the Y direction which is the rotation circumferential direction of the photosensitive drum 13 is suppressed.

Figure 8:
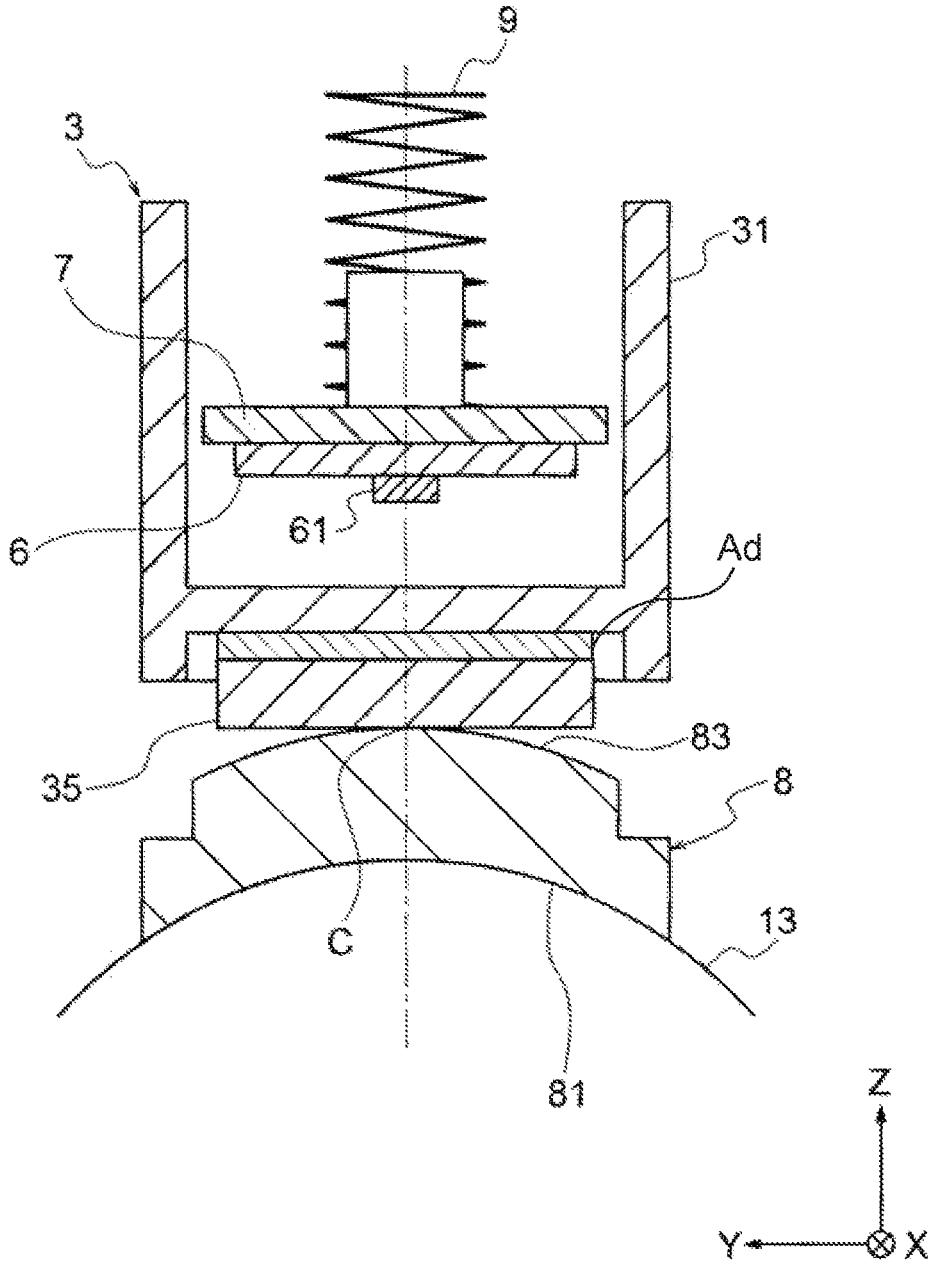
FIG. 8 is a cross-sectional view illustrating the LED head, the photosensitive drum and the spacer according to the first embodiment.

FIG. 8 is a sectional view schematically illustrating a contact portion between the spacer 8 and the plate 35 in a plane parallel to the YZ plane. The drum contact surface 81 of the spacer 8 contacts against the surface 13*c* of the photosensitive drum 13 and the head contact surface 83 of the spacer 8 contacts against the plate 35 of the holder 3.

The drum contact surface 81 of the spacer 8 is a curved surface having substantially the same shape as the surface 13*c* (outer peripheral surface) of the photosensitive drum 13. Therefore, the drum contact surface 81 of the spacer 8 and the surface 13*c* of the photosensitive drum 13 are brought into close contact with each other. Further, although the head contact surface 83 is a curved surface, the opposing surface of the plate 35 of the holder 3 is a flat surface. Therefore, the head contact surface 83 contacts on the plate 35 at one position in the circumferential direction.

As described above, the spacer 8 contacts against the surface 13*c* of the photosensitive drum 13 at the drum contact surface 81 at both ends in the X direction of the LED head 15, and is in contact with the plate 35 of the holder 3 at the head contact surface 83. As a result, the distance Li between the LED head 15 and the photosensitive drum 13 is regulated.

<Attaching Structure of the Spacer>

Figure 9:
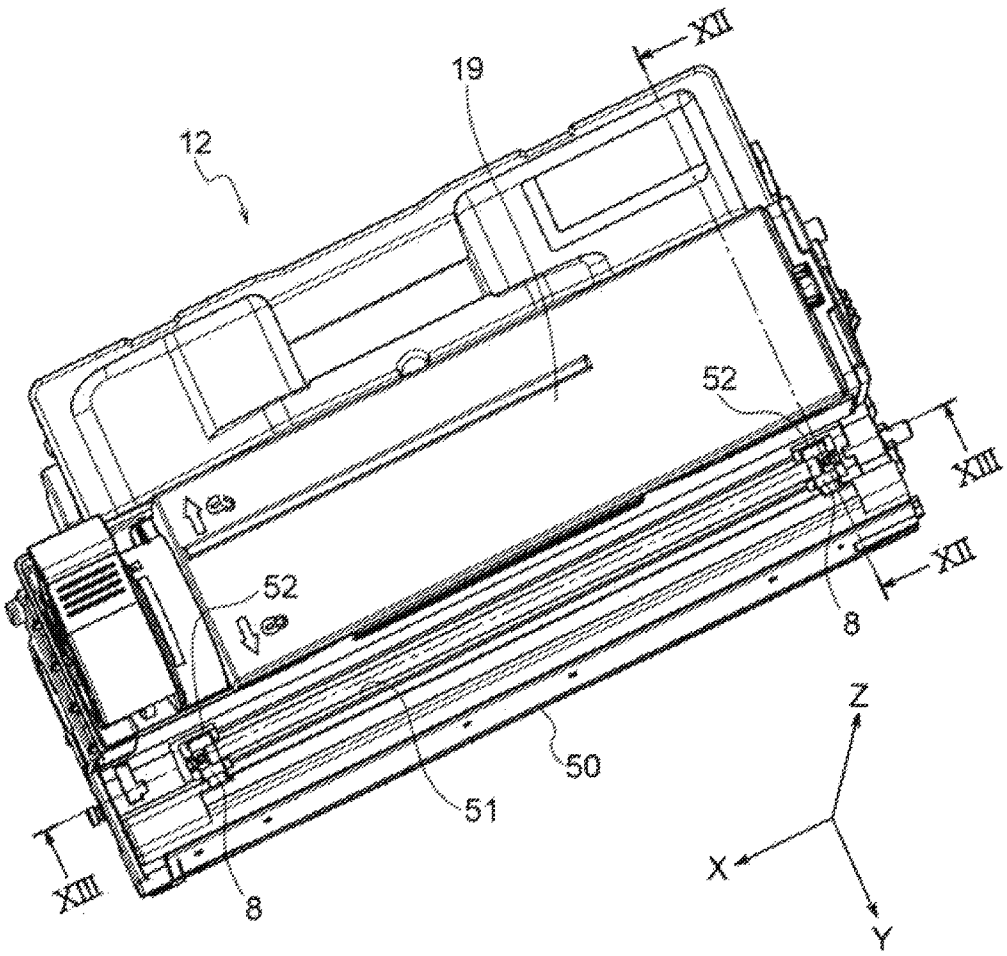
FIG. 9 is a perspective view illustrating a process unit according to the first embodiment.
Figure 10:
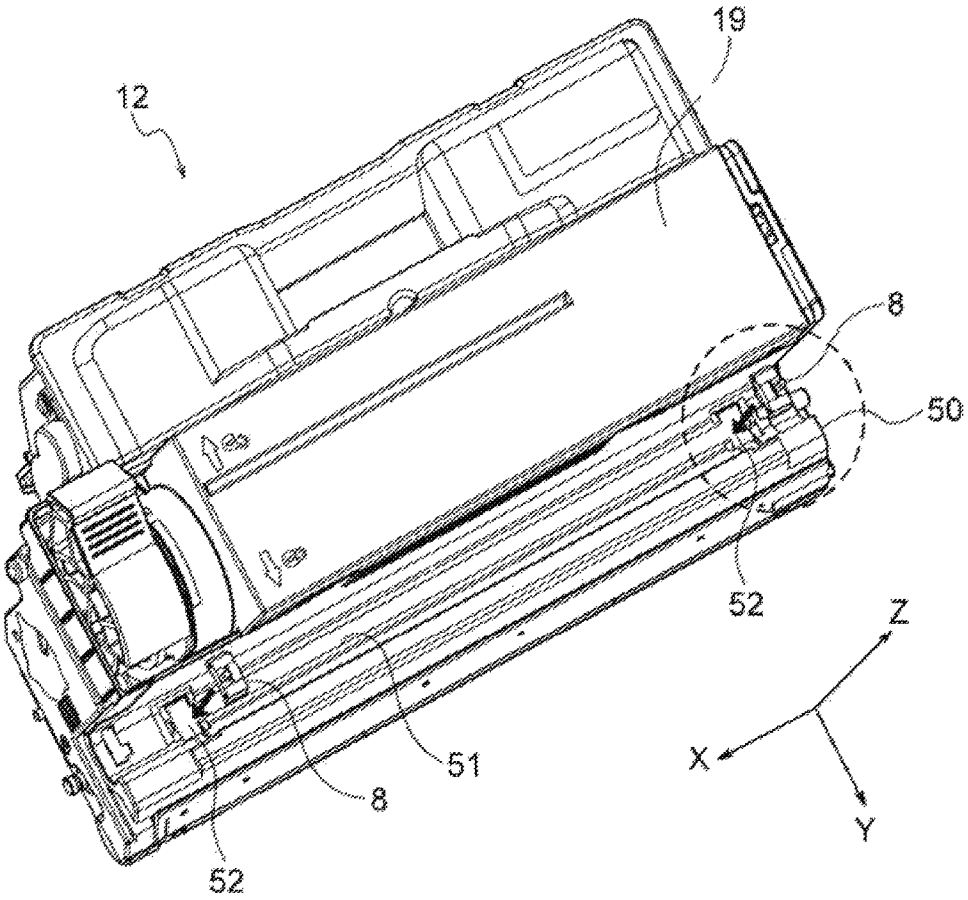
FIG. 10 is a perspective view illustrating a process unit according to the first embodiment.
Figure 11:
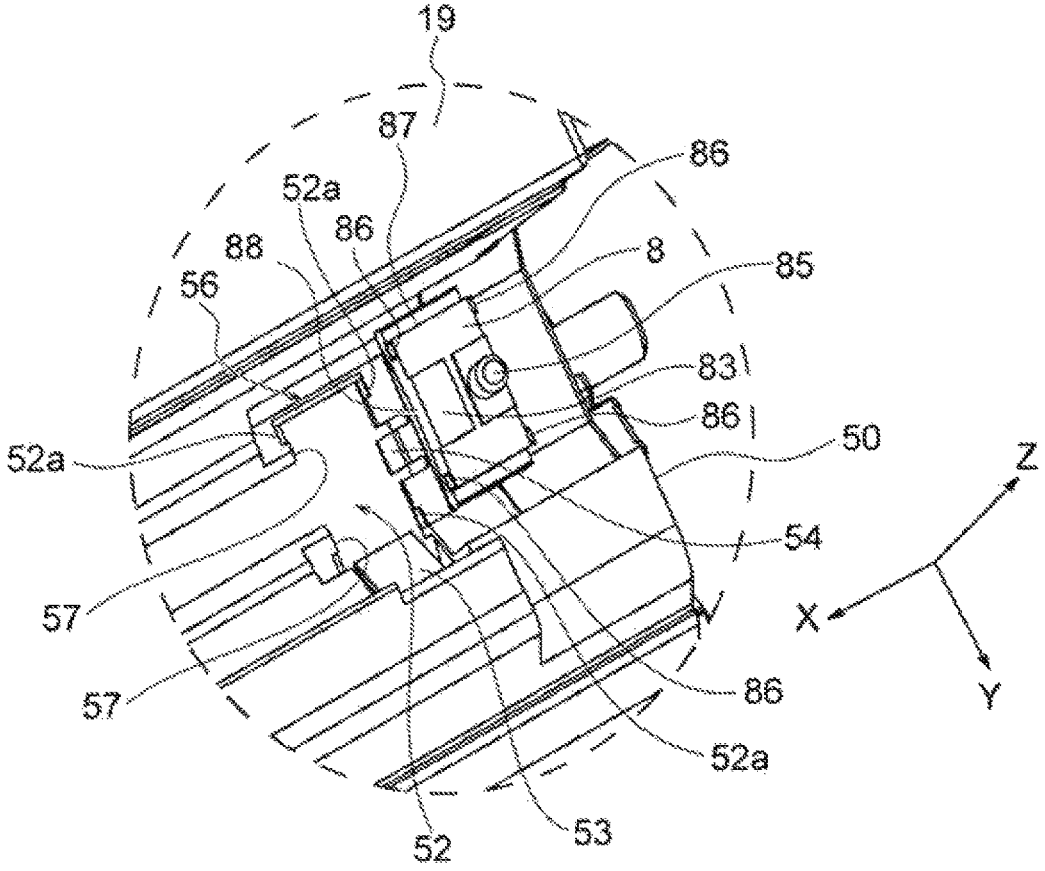
FIG. 11 is an enlarged perspective view illustrating a part of the process unit shown in FIG. 10.

Next, a structure for attaching the spacer 8 to the unit frame 50 of the process unit 12 will be described. FIG. 9 is a perspective view illustrating a state in which the spacer 8 is attached to the unit frame 50 of the process unit 12. FIG. 10 is a perspective view illustrating a state before attaching the spacer 8 to the unit frame 50. FIG. 11 is an enlarged view of a portion surrounded by a circle (broken line) in FIG. 10.

As shown in FIG. 9, the process unit 12 houses the photosensitive drum 13, the charge roller 14, the development roller 16, the toner supply roller 17, and the development blade 18, and includes the unit frame 50 having a toner cartridge 19. The unit frame 50 is made of, for example, acrylonitrile-butadiene-styrene resin (ABS resin) or the like.

As shown in FIGS. 9 and 10, in the unit frame 50, an opening portion (long hole) 51 elongated in the X direction is formed above the photosensitive drum 13 (the +Z direction). The opening portion 51 is an opening for guiding the light emitted from the LED array chip 61 of the LED head 15 to the photosensitive drum 13. The length of the opening portion 51 in the X direction is longer than the length of the LED array chip 61 in the X direction.

An opening portions 52 (FIG. 10) for attaching the spacers 8 are formed at both ends of the opening portion 51 in the X direction. Here, the opening portions 52 are an opening portions having a wide width (dimension in the Y direction) continuously formed at the end portion in the X direction of the opening portion 51.

FIG. 11 is an enlarged view illustrating the periphery of the opening portion 52 formed in the unit frame 50. The shape of the opening portion 52 is substantially the same as that of the spacer 8. A receiving portion 52*a* for receiving the projecting piece 86 (FIG. 5) of the spacer 8 is formed at both end edges of the opening portion 52 in the X direction.

In the +Y direction end portion of the opening portion 52, the Y direction energizing portion 53 as a first energizing portion for pressing the spacer 8 in the −Y direction is disposed. The Y direction energizing portion 53 is a portion formed by making the part of the unit frame 50 slightly thin and being elastically deformable. The Y direction positioning surface 56 as a third contact portion is formed at the end portion in the −Y direction of the opening portion 52 so as to face the Y direction energizing portion 53. The Y direction positioning surface 56 is a surface positioned on the downstream side in the rotation direction of the photosensitive drum 13 with respect to the spacer 8.

Figure 12:
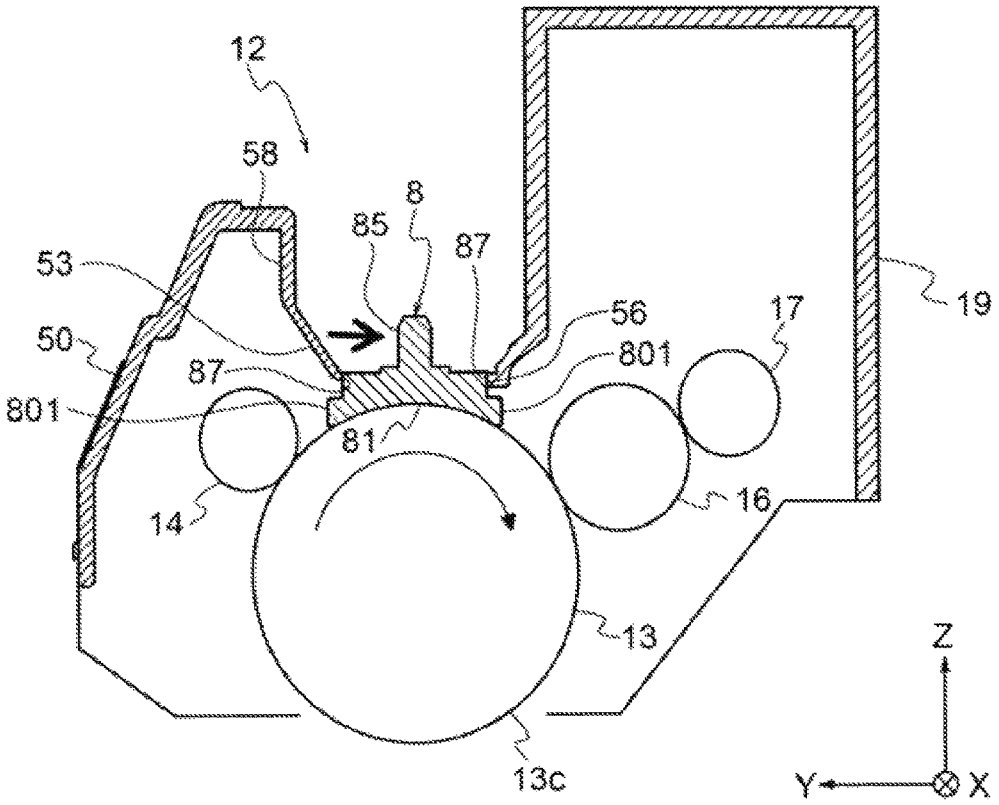
FIG. 12 is a cross-sectional view illustrating the process unit in the first embodiment.

FIG. 12 is a cross-sectional view in the direction of the arrow in the line XII-XII shown in FIG. 9. The Y direction energizing portion 53 extends in the −Z direction and in the −Y direction from the wall portion 58 adjacent in the +Y direction of the opening portion 52 of the unit frame 50.

When the spacer 8 is attached to the opening portion 52, the Y direction energizing portion 53 is slightly elastically deformed in the +Y direction. The Y direction energizing portion 53 presses the Y direction end surface 87 of the spacer 8 in the −Y direction by its elastic restoring force. The spacer 8 pressed in the −Y direction by the Y direction energizing portion 53 is pressed against the Y direction positioning surface 56 in the other Y direction end face 87. As a result, the position of the spacer 8 in the Y direction is determined.

The Y direction energizing portion 53 is not limited to an elastically deformable portion in which a part of the unit frame 50 is formed to be slightly thin. For example, an elastic member may be attached to the edge of the opening portion 52.

Figure 13:
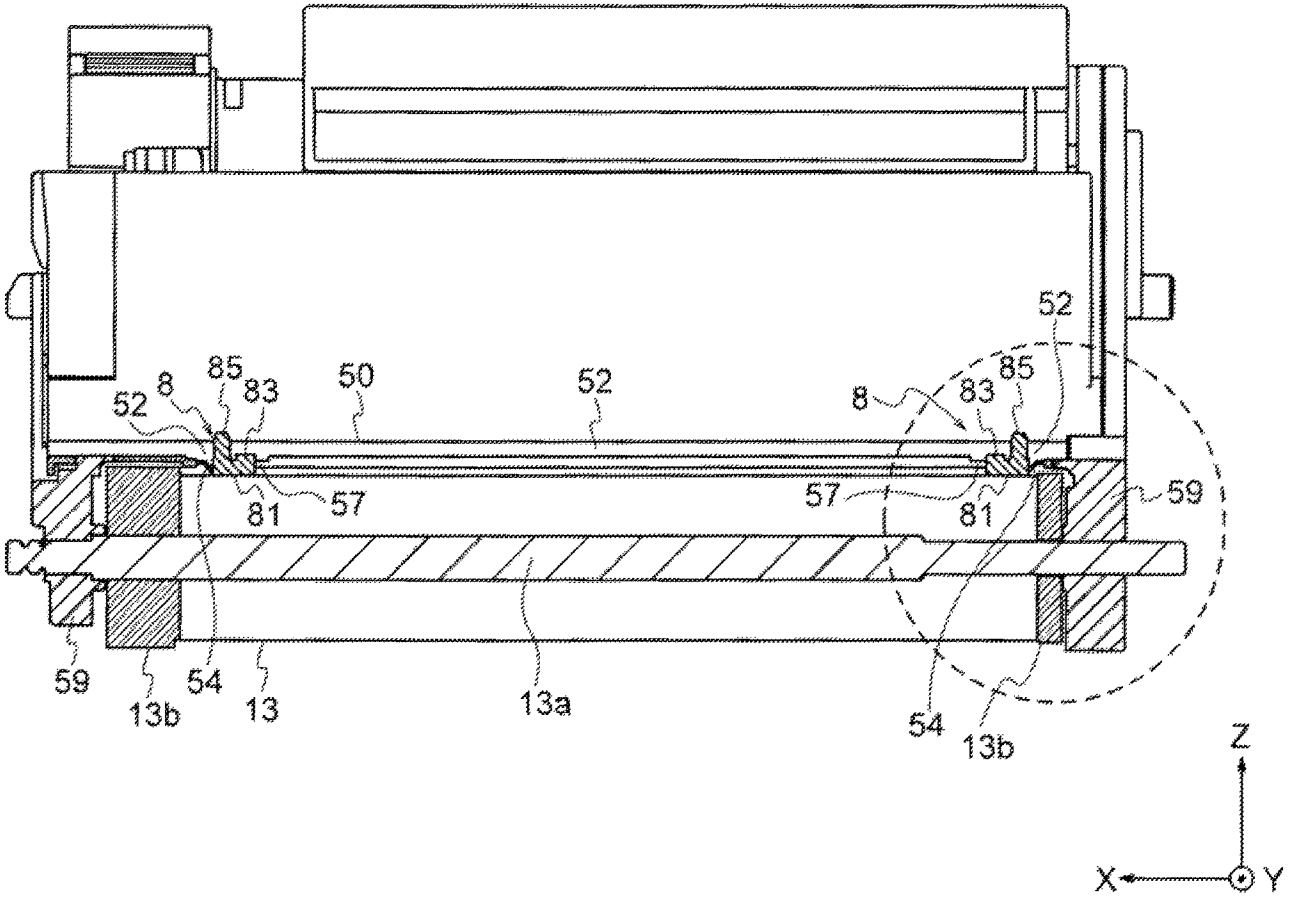
FIG. 13 is a partial cross-sectional view illustrating a part of the process unit in the first embodiment.

FIG. 13 is a cross-sectional view taken along line XIII-XIII in FIG. 9 in the direction of the arrows. The X direction energizing portion 54 that presses the spacer 8 inward in the X direction is disposed at the X direction outer end portion of the pair of opening portions 52. The X direction energizing portion 54 is an elastic member attached to the edge of the opening portion 52. An X direction positioning surface 57 as a fourth contact portion is formed at an end portion on the inner side in the X direction of the opening portion 52 so as to face the X direction energizing portion 54.

Figure 14:
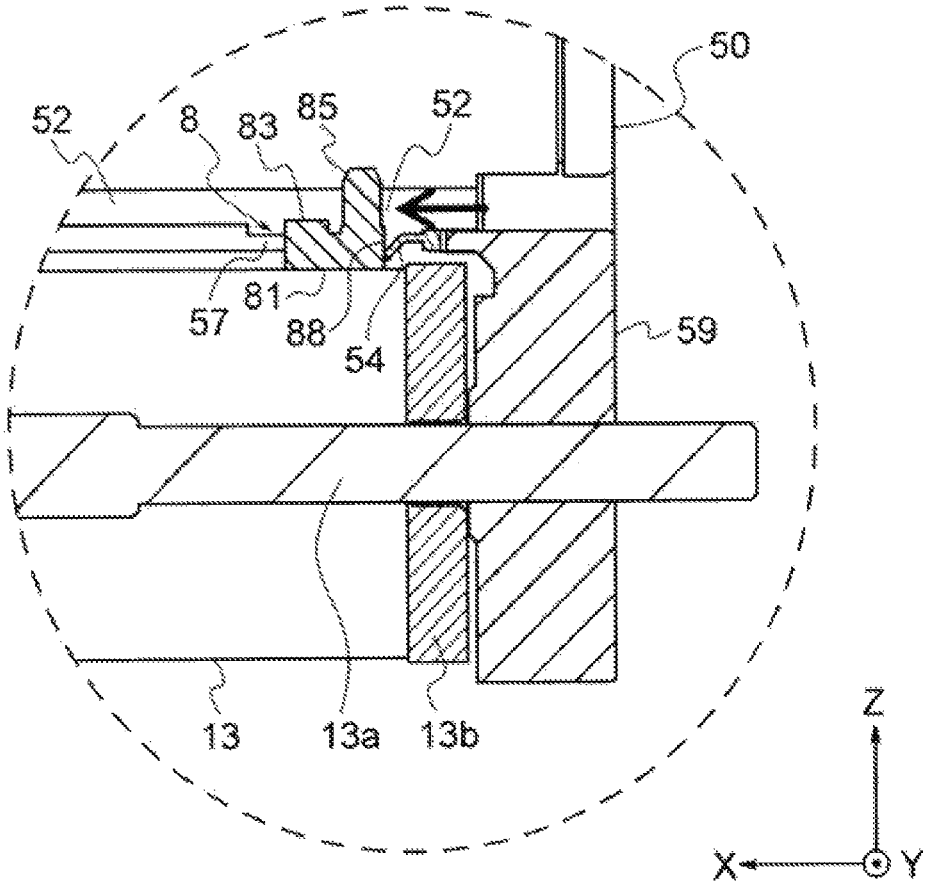
FIG. 14 is an enlarged cross-sectional view illustrating a part of the process unit in the first embodiment.

FIG. 14 is an enlarged view of a portion surrounded by a circle (broken line) in FIG. 13. The X direction energizing portion 54 extends from the edge on the outer side in the X direction of the opening portion 52 of the unit frame 50 in the −Z direction and inward in the X direction.

When the spacer 8 is attached to the opening portion 52, the X direction energizing portion 54 is slightly elastically deformed outward in the X direction. The X direction energizing portion 54 presses the X direction end face 88 of the spacer 8 inward in the X direction by its elastic restoring force. The spacer 8 pressed in the −Y direction by the X direction energizing portion 54 is pressed against the X direction positioning surface 57 on the other X direction end face 88. As a result, the position of the spacer 8 in the Y direction is determined.

The X direction energizing portion 54 is not limited to the elastic member attached to the opening portion 52. A part of the unit frame 50 may be formed to be slightly thin so as to be elastically deformable.

In this manner, the spacer 8 is positioned in the X direction (main scanning direction) and the Y direction (sub scanning direction) with respect to the unit frame 50. Since the protrusion 85 of the spacer 8 is engaged with the engagement hole 36 of the holder 3 of the LED head 15, the LED head 15 is also positioned in the X direction and the Y direction with respect to the unit frame 50.

<Operation of Image Forming Apparatus>

Next, the image forming operation of the image forming apparatus 10 will be described with reference to FIGS. 1 and 2. When the image forming operation is started, the hopping roller 22 rotates to send the sheets stored in the sheet cassette 24 one by one to the conveying path. Further, the pair of registration rollers 23 rotate at a predetermined timing, and the sheet sent to the conveyance path is conveyed to the conveyance belt 21. The conveyor belt 21 travels in the direction indicated by the arrow e by the rotation of the drive roller 21*a* and sucks and holds the sheet to convey it.

On the other hand, in the process units 12Bk, 12Y, 12M, 12C, the surfaces of the photosensitive drums 13Bk, 13Y, 13M, 13C are uniformly charged by the charge rollers 14Bk, 14Y, 14M, 14C, respectively.

Further, the LED heads 15Bk, 15Y, 15M, 15C irradiate light according to image data for each color. As shown in FIG. 2, in each LED head 15, the light emitted from the LED array chip 61 on the substrate 6 is incident on the incident end surface 2*b* of the rod lens array 2. Further, light is emitted from the exit end surface 2*a* of the rod lens array 2 and converges on the surface 13*c* of the photoreceptor drum 13. As a result, an electrostatic latent image is formed on the photosensitive layer on the surface 13*c* of the photosensitive drum 13.

Returning to FIG. 1, the electrostatic latent images formed on the surfaces of the photosensitive drums 13Bk, 13Y, 13M, 13C are developed by the development rollers 16Bk, 16Y, 16M, 16C to become toner images. Further, as the conveyor belt 21 runs, the sheet passes between the process units 12Bk, 12Y, 12M, 12C and the transfer rollers 20Bk, 20Y, 20M, 20C. At this time, the toner images formed on the surfaces of the photosensitive drums 13Bk, 13Y, 13M, 13C are sequentially transferred onto the sheet on the conveying belt 21.

The sheet on which the toner image has been transferred is sent to the fuser device 28. In the fuser device 28, the toner image is heated and pressurized by the fuser roller 28*a* and the pressure roller 28*b*. Then, the toner image is melted and fused on the sheet. The sheet on which the toner image has been fused is discharged to the outside of the image forming apparatus 10 by the pair of discharge rollers 26 and 27. Then, it is stacked on a stacker unit 29 provided at the top of the image forming apparatus 10.

<Positioning the LED Head>

Next, positioning of the LED head 15 with respect to the photosensitive drum 13 will be described with reference to FIGS. 7, 12 and 14. On the surface 13*c* of the photosensitive drum 13 of the process unit 12, as shown in FIG. 7, a pair of spacers 8 are arranged. The spacer 8 is in contact with the surface 13*c* of the photosensitive drum 13 at its drum contact surface 81.

Each spacer 8 is pressed against the Y direction positioning surface 56 and the X direction positioning surface 57 by the Y direction energizing portion 53 and the X direction energizing portion 54 provided in the unit frame 50. Each spacer 8 is positioned in the X direction (main scanning direction) and the Y direction (sub scanning direction) with respect to the unit frame 50.

When the LED head 15 is attached to the image forming apparatus 10, the LED head 15 is disposed above the photosensitive drum 13 of the process unit 12. At this time, as shown in FIG. 7, the protrusions 85 of the respective spacers 8 are engaged with the engagement holes 36 provided at both ends in the X direction of the LED head 15. As a result, the LED head 15 is positioned in the X direction (main scanning direction) and the Y direction (sub scanning direction) with respect to the photosensitive drum 13.

Further, the plates 35 provided at both ends of the LED head 15 in the X direction contact against the head contact surface 83 of the spacer 8. In this state, the coil spring 9 energizes the LED head 15 toward the photosensitive drum 13, so that the distance Li between the emitting end surface 2*a* of the rod lens array 2 and the surface 13*c* of the photosensitive drum 13 is kept constant.

In this manner, the pair of spacers 8 disposed on the photosensitive drum 13 is provided with a portion (the drum contact surface 81 and the head contact surface 83) for restricting the distance from the photosensitive drum 13 and a portion (protrusion 85) for positioning the LED head 15 in the X direction and the Y direction. Therefore, with a simple configuration, it is possible to regulate the distance between the LED head 15 and the photosensitive drum 13 and further to position the LED head 15 in the X direction and the Y direction.

In this embodiment, projections 85 for positioning the LED head 15 are provided in the pair of spacers 8 arranged on the photosensitive drum 13. Therefore, it is not necessary to lengthen the length of the LED head 15, and it is possible to realize a configuration for positioning the LED head 15. Therefore, it is possible to reduce the size of the LED head 15 and to reduce the manufacturing cost.

In addition, the spacer 8 is pressed in the Y direction to the Y direction positioning surface 56 by the Y direction energizing portion 53 provided in the unit frame 50. Further, the spacer 8 is pressed against the X direction positioning surface 57 in the X direction by the X direction energizing portion 54. Therefore, it is possible to accurately maintain the position of the spacer 8 in the X direction and the Y direction. As a result, the position of the LED head 15 in the X direction and the Y direction is also accurately maintained, the exposure accuracy can be improved, and the image quality can be improved.

In particular, the spacer 8 receives a force (frictional force) in the −Y direction as the photosensitive drum 13 rotates, but a Y direction positioning surface 56 is arranged in that direction. Therefore, by the contact between the spacer 8 and the Y direction positioning surface 56, the positional displacement of the spacer 8 in the Y direction is suppressed. Thus, it is possible to suppress the positional displacement of the LED head 15.

Since the drum contact surface 81 of the spacer 8 is a curved surface having the same curvature as the surface of the photosensitive drum 13, the drum contact surface 81 of the spacer 8 and the surface of the photosensitive drum 13 can be brought into close contact with each other. Therefore, foreign matter such as toner or the like is prevented from entering between the spacer 8 and the photosensitive drum 13, and the distance between the LED head 15 and the photosensitive drum 13 can be accurately maintained.

Further, since the head contact surface 83 of the spacer 8 is a curved surface (a cylindrical surface coaxial with the photosensitive drum 13) which is convex portion toward the LED head 15 side, as shown in FIG. 8, the spacer 8 and the plate 35 contact at one position in the circumferential direction of the head contact surface 83. Therefore, even when the spacer 8 or the plate 35 is inclined due to assembling error or the like, the interval between the LED head 15 and the photosensitive drum 13 can be accurately maintained.

As shown in FIG. 12, projecting portions (stopper portions) 801 may be provided on both end surfaces in the Y direction of the spacer 8. Since the projecting portion 801 can contact the opening portion 52 of the unit frame 50 from below, the spacer 8 is prevented from coming out of the opening portion 52, for example, even if receiving vibration during transportation. This projecting portion 801 is omitted in FIG. 5.

<Effect of the Embodiment>

As described above, the image forming apparatus 10 of the present invention includes the spacer 8 that regulates the distance between the photosensitive drum 13 and the LED head 15. The spacer 8 has a drum contact surface 81 (a first contact portion) contacting against the surface 13*c* (outer circumferential surface) of the photosensitive drum 13, and a head contact surface 83 (a second contact surface) contacting against the LED head 15. The LED head 15 has an engagement hole 36 (a first engagement portion) that engages with the spacer 8. The spacer 8 has a protrusion 85 (a second engagement portion) that engages with the engagement hole 36 and restricts the movement of the LED head 15 in the Y direction (rotation direction of the photosensitive drum 13). Therefore, the distance between the photosensitive drum 13 and the LED head 15 is regulated by the spacer 8. Further, the engagement between the protrusion 85 and the engagement hole 36 enables the LED head 15 to be positioned with respect to the photosensitive drum 13.

Further, the unit frame 50 (a holding portion) includes an opening portion 52 to which the spacer 8 is attached, the Y direction energizing portion 53 for energizing the spacer 8 in the −Y direction (the downstream side in the rotation direction of the photosensitive drum 13) and the Y direction positioning surface 56 (a third contact portion) arranged in the −Y direction of the opening 52. Therefore, positional displacement of the spacer 8 in the Y direction with respect to the unit frame 50 due to the rotation of the photosensitive drum 13 can be suppressed.

Further, the unit frame 50 has an X direction energizing portion 54 that energizes the spacer 8 inward in the X direction (the direction toward the center of the photosensitive drum 13) and an X direction positioning surface 57 (a fourth contact portion) that faces the X direction energizing portion 54 in the X direction. Therefore, the positional displacement of the spacer 8 in the X direction with respect to the unit frame 50 can be suppressed.

The opening portion 52 for attaching the spacer 8 in the unit frame 50 is formed continuously with the longitudinal end portion of the opening portion 51 (long hole) for guiding the light of the LED head 15 to the photosensitive drum 13. Therefore, it is possible to arrange the spacer 8 as close as possible to the LED array chip 61 in the X direction. As a result, the length of the LED array chip 61 in the X direction can be shortened.

The drum contact surface 81 of the spacer 8 is a curved surface having substantially the same shape as the outer peripheral surface of the photosensitive drum 13. Therefore, the drum contact surface 81 of the spacer 8 and the outer peripheral surface of the photosensitive drum 13 can be brought into close contact with each other. As a result, it is possible to prevent foreign matters such as toner from entering the gaps.

Further, the head contact surface 83 of the spacer 8 is disposed on the center side of the photosensitive drum 13 in the X direction with respect to the protrusion 85. Therefore, the head contact surface 83 and the protrusion 85 can be arranged in a comparatively narrow space in the circumferential direction of the photosensitive drum 13.

Further, the head contact surface 83 of the spacer 8 is a curved surface that is convex toward the LED head 15 side. Therefore, even when the spacer 8 or the plate 35 is inclined due to assembling error or the like, the interval between the LED head 15 and the photosensitive drum 13 can be accurately maintained.

Further, the pair of spacers 8 are arranged at both end portions of the LED head 15 in the X direction. Therefore, it is possible to accurately position the elongated LED head 15 with respect to the photosensitive drum 13.

<Modified Example>

In the above described embodiment, the color printer (FIG. 1) has been described as an example of the image forming apparatus. However, the image forming apparatus of the present invention is not limited to a color printer, but may be a monochrome printer, for example. Further, the image forming apparatus of the present invention is not limited to a printer, but may be a copying machine, a facsimile apparatus, a multifunction machine, or the like.

In the above described embodiment, the Y direction energizing portion 53 and the X direction energizing portion 54 are provided in the unit frame 50 of the process unit 12. However, not limited to the unit frame 50, the Y direction energizing portion 53 and the X direction energizing portion 54 may be provided in a portion (the holding portion) for holding the photosensitive drum 13.

In the above described embodiment, the energizing portions (the Y direction energizing portion 53 and the X direction energizing portion 54) are provided on the unit frame 50 so that the spacer 8 is pressed against the positioning surfaces 56 and 57. However, the energizing portions may be provided on the spacer 8. That is, the spacer 8 may be pressed against the positioning surfaces 56 and 57 by the energizing force of the energizing portion provided on the spacer 8.

In the above described embodiment, the engagement hole 36 is provided in the holder 3 of the LED head 15, and the protrusion 85 is provided on the spacer 8. However, a protrusion may be provided on the holder 3 of the LED head 15, and an engagement hole may be provided on the spacer 8.

Further, instead of providing the protrusion 85 on the spacer 8, a protrusion is provided on a pair of side frames 59 (FIG. 13) supporting the photosensitive drum 13 in the unit frame 50. And, the protrusion may be engaged with the engagement hole 36 of the holder 3 of the LED head 15.

The embodiments of the present invention have been concretely described above. However, the present invention is not limited to the above described embodiments, and various improvements or modifications can be made without departing from the gist of the present invention.

The invention claimed is:

1. An image forming apparatus, comprising:

an image carrier configured to rotate in a predetermined direction;

an exposure unit configured to expose the image carrier;

a spacer that includes a first contact portion contacting against an outer peripheral surface of the image carrier and a second contact portion contacting against the exposure unit, and configured to regulate the interval between the image carrier and the exposure unit;

a holding portion configured to hold the image carrier, the holding portion comprising an opening portion to which the spacer is attached, a first energizing portion configured to energize the spacer toward a downstream side in the predetermined direction at the opening portion, and a third contact portion disposed on the downstream side in the predetermined direction at the opening portion, and contacting on the spacer; and a pressing portion configured to press the exposure unit toward the spacer, wherein:

the exposure unit includes a first engagement portion configured to engage with the spacer, and the spacer includes a second engagement portion configured to engage with the first engagement portion and to restrict a movement of the exposure unit in the predetermined direction.

2. The image forming apparatus according to claim 1, wherein the holding portion comprises:

a second energizing portion that energizes the spacer in a direction toward the center of the image carrier in a direction of a rotation axis of the image carrier; and a fourth contact portion that is arranged at the opening portion so to face the second energizing portion in a direction of a rotation axis, and configured to contact against the spacer.

3. The image forming apparatus according to claim 1, wherein the holding portion comprises a long hole elongated in a direction of a rotation axis of the image carrier, and configured to guide the light of the exposure unit to the image carrier, and the opening portion is formed continuously with an end portion in a longitudinal direction of the long hole.

4. The image forming apparatus according to claim 1, wherein the second engagement portion of the spacer is configured to restrict a movement of the exposure unit in a direction of a rotation axis of the image carrier.

5. The image forming apparatus according to claim 1, wherein the first contact portion is a curved surface having substantially the same shape as the outer peripheral surface of the image carrier.

6. The image forming apparatus according to claim 1, wherein the second contact portion is disposed on a center side of the image carrier in a direction of a rotation axis of the image carrier with respect to the second engagement portion.

7. The image forming apparatus according to claim 1, wherein the first engagement portion has a concave shape, and the second engagement portion has a convex shape.

8. The image forming apparatus according to claim 1, wherein the spacer comprises an opposing surface facing the exposure unit, and the second contact portion and the second engagement portion protrude from the opposing surface toward the exposure unit.

9. The image forming apparatus according to claim 1, wherein the second contact portion is a curved surface which is convex toward the exposure unit.

10. The image forming apparatus according to claim 1, wherein there are a pair of spacers, and the pair of spacers are disposed at both ends of the exposure unit in a direction of a rotation axis of the image carrier.

11. The image forming apparatus according to claim 1, wherein the exposure unit comprises:

a substrate comprising a plurality of light emitting elements arranged in a direction of a rotation axis of the image carrier; and a holder configured to hold the substrate, wherein in the holder, a pair of the first engagement portions are disposed on both sides of the plurality of light emitting elements in a direction of a rotation axis of the image carrier.

12. An image forming apparatus, comprising:

an image carrier configured to rotate in a predetermined direction;

an exposure unit configured to expose the image carrier;

a spacer that includes a first contact portion contacting against an outer peripheral surface of the image carrier and a second contact portion contacting against the exposure unit, and configured to regulate the interval between the image carrier and the exposure unit; and a pressing portion configured to press the exposure unit toward the spacer, wherein:

the exposure unit includes a first engagement portion configured to engage with the spacer, the spacer includes a second engagement portion configured to engage with the first engagement portion and to restrict a movement of the exposure unit in the predetermined direction, and the second engagement portion of the spacer is configured to restrict a movement of the exposure unit in a direction of a rotation axis of the image carrier.

13. The image forming apparatus according to claim 12, wherein a holding portion configured to hold the image carrier, wherein the holding portion comprises:

an opening portion to which the spacer is attached;

a first energizing portion that energizes the spacer in a direction toward the center of the image carrier in a direction of a rotation axis of the image carrier; and a third contact portion that is arranged at the opening portion so to face the second energizing portion in a direction of a rotation axis, and configured to contact against the spacer.

14. The image forming apparatus according to claim 13, wherein the holding portion comprises a long hole elongated in a direction of a rotation axis of the image carrier, and configured to guide the light of the exposure unit to the image carrier, and the opening portion is formed continuously with an end portion in a longitudinal direction of the long hole.

15. The image forming apparatus according to claim 12, wherein the first contact portion is a curved surface having substantially the same shape as the outer peripheral surface of the image carrier.

16. The image forming apparatus according to claim 12, wherein the second contact portion is disposed on a center side of the image carrier in a direction of a rotation axis of the image carrier with respect to the second engagement portion.

17. The image forming apparatus according to claim 12, wherein the first engagement portion has a concave shape, and the second engagement portion has a convex shape.

18. The image forming apparatus according to claim 12, wherein the second contact portion is a curved surface which is convex toward the exposure unit.

19. The image forming apparatus according to claim 12, wherein there are a pair of spacers, and the pair of spacers are disposed at both ends of the exposure unit in a direction of a rotation axis of the image carrier.

20. The image forming apparatus according to claim 12, wherein the exposure unit comprises:

a substrate comprising a plurality of light emitting elements arranged in a direction of a rotation axis of the image carrier; and a holder configured to hold the substrate, wherein in the holder, a pair of the first engagement portions are disposed on both sides of the plurality of light emitting elements in a direction of a rotation axis of the image carrier.

* * * * *